US007534122B2

(12) United States Patent
Byrne

(10) Patent No.: US 7,534,122 B2
(45) Date of Patent: May 19, 2009

(54) TWO POSITION LATCH ASSEMBLY

(76) Inventor: Norman R. Byrne, 2736 Honey Creek NE., Ada, MI (US) 49301

( * ) Notice: Subject to any disclaimer, the term of this patent is extended or adjusted under 35 U.S.C. 154(b) by 0 days.

(21) Appl. No.: 11/912,573

(22) PCT Filed: Apr. 28, 2006

(86) PCT No.: PCT/US2006/016240

§ 371 (c)(1),
(2), (4) Date: Oct. 25, 2007

(87) PCT Pub. No.: WO2006/116679

PCT Pub. Date: Nov. 2, 2006

(65) Prior Publication Data

US 2008/0188113 A1 Aug. 7, 2008

Related U.S. Application Data

(60) Provisional application No. 60/675,622, filed on Apr. 28, 2005.

(51) Int. Cl.
*H01R 4/60* (2006.01)

(52) U.S. Cl. ..... 439/215

(58) Field of Classification Search ..... 439/215, 439/557, 532, 575, 574, 527
See application file for complete search history.

(56) References Cited

U.S. PATENT DOCUMENTS

| | | | | |
|---|---|---|---|---|
| 4,747,506 | A * | 5/1988 | Stuchlik, III | 220/3.9 |
| 4,775,328 | A * | 10/1988 | McCarthy | 439/211 |
| 5,924,879 | A * | 7/1999 | Kameyama | 439/141 |
| 6,343,947 | B1 * | 2/2002 | Byrne | 439/357 |
| 6,755,684 | B1 * | 6/2004 | Hueniken et al. | 439/532 |
| 2005/0142935 | A1 * | 6/2005 | Tsai et al. | 439/557 |

* cited by examiner

*Primary Examiner*—Phuong K Dinh
(74) *Attorney, Agent, or Firm*—Varnum, Riddering, Schmidt & Howlett LLP

(57) ABSTRACT

A junction block housing (400) is releasably coupled to a structural member (402) through the use of mounting lugs (404, 406) and brackets (408, 410). A latch assembly (428) consists of a first cantilever beam (430) and a second cantilever beam (432). A center extension (436) and lateral extensions (438) are coupled to said cantilever beams (430, 432) so as to releasably capture a retainer tab (426) at either of two positions relative to said junction block housing (400).

6 Claims, 13 Drawing Sheets

TWO POSITION LATCH ASSEMBLY

CROSS-REFERENCE TO RELATED APPLICATIONS

This application claims priority of U.S. Provisional Application Ser. No. 60/675,622 filed Apr. 28, 2005.

CLAIM OF PRIORITY

Not applicable.

STATEMENT REGARDING FEDERALLY SPONSORED RESEARCH OR DEVELOPMENT

Not applicable.

REFERENCE TO MICROFISHE APPENDIX

Not applicable.

BACKGROUND OF THE INVENTION

1. Field of the Invention

The invention relates to apparatus for mounting electrical junction blocks and the like and, more particularly, to an arrangement for mounting such devices in confined areas such as electrical raceways.

2. Description of Related Art

Modern office arrangements often employ removable wall panels or the like to define work areas. Such panels and other structures often have a raceway area for accommodating electrical wiring and electrical junction blocks near the floor or in other locations which do not provide easy access to technicians. Typically, junction blocks are mounted within such raceway areas by attaching them to support brackets. Since the electrical wiring requirements and locations of the junction blocks, some of which may include outlet boxes and the like, depend on the ever-changing needs of the users, junction blocks are often installed or removed after the wall panel structures are in place. Installing or removing a junction block positioned, for example, near the bottom of a wall panel and essentially at floor level, is often an arduous task. Furthermore, the only convenient access to a wall panel may be from only one side. Therefore, it is desirable that junction blocks are easily insertable and removable, and that they are insertable and removable from either side of the wall panel.

U.S. Pat. No. 4,993,576, issued Feb. 19, 1991 to the inventor of the present invention, shows a junction block provided with a latching mechanism comprising a pair of opposing interlocking members hingedly attached to a junction block and arranged to define a channel between opposing edges for engaging a retainer tab. A similar device is disclosed in U.S. Pat. No. 5,051,203 issued May 14, 1991 to Furrow. Junction blocks are typically constructed by adjoining two complementary, separately molded, half sections. The latching arrangement typically has one of the engaging sections molded as an integral part of one half section and the opposing part molded as an integral part of the other half section. The prior art latches comprise opposing and interlocking tongues and grooves. Unless special precautions are taken in the manufacture of these parts, the opposing sections may not be properly aligned, resulting in improper operation of the latch arrangements. A further disadvantage of such prior art arrangements is that a grooved section defined between the opposing edges tends to be reduced in size when the interlocking members are depressed, potentially causing a binding of the tab retained between the opposing edges of the interlocking members.

U.S. Pat. No. 5,259,787, issued Nov. 9, 1993 to the inventor of the present invention, and which is incorporated by reference herein, shows a junction block latching mechanism comprising a latch arm constructed as a cantilever beam. The cantilever beam extends from an outer wall of the junction block and is provided with a transversely extending channel for engagement with a retaining tab attached to a structural member designed to receive the junction block. A shortcoming of a latching mechanism employing such a cantilever beam construction is that it may be difficult to insert the junction block from one side of the frame due to the fact that the free end of the cantilever beam latch is raised to a position such that its ends abut against the tab, thereby preventing an easy installation.

SUMMARY OF THE INVENTION

In accordance with the invention, an electrical connection member is mounted on a structural support member. The connection member includes a housing with an outer wall having spaced apart first and second opposing side edges. These side edges are disposed equidistant from a longitudinally extending centerline of the housing. A latch member is disposed on the outer wall for engagement with the structural support member.

The latch member includes first and second cantilever beams. Each beam is connected to the housing. The first cantilever beam has a proximal end attached to the outer wall at a first hinged location disposed between the centerline and the first side edge. The cantilever beam is coupled to a center extension extending from an edge of the beam between the centerline and the first side edge, with the center extension terminating between the centerline and the second side edge. The second cantilever beam has a proximal end attached to the outer wall at a location disposed between the centerline and the second side edge. The second beam also includes a pair of lateral extensions, each having a proximal end secured to the second cantilever beam at a location disposed between the centerline and the second side edge. The lateral extensions terminate at a free distal end between the second centerline and the first side edge.

The latch member includes first capturing means for capturing a lower terminating end of a vertically disposed retainer tab at a first captured position. This results in the lower terminating end of the retainer tab being positioned a first length above the outer wall. The latch member also includes second capturing means associated with the first and second beams, for capturing the lower end of the retainer tab at a second captured position. The second position has the lower end of the retainer tab at a second length above the outer wall. The first length is different than the second length.

The first capturing means is formed as a first channel from top surfaces of the center and lateral extensions. A first ledge set includes a pair of ledges forming the first channel and integral with the center and lateral extensions. The second capturing means is formed as a second channel, by a pair of ledged surfaces integral with the center extension and the lateral extensions. The retainer tab is releasable from the first and second capturing means by a user exerting downward pressure on either of the first or second beams, so as to cause the beams to move to a full release position.

BRIEF DESCRIPTION OF THE DRAWING

An illustrative embodiment of the invention is described in the following paragraphs with reference to the drawing, in which.

DETAILED DESCRIPTION

The principles of the invention are disclosed, by way of example, in a two position latch assembly illustrated in FIGS. 7-17, and described in subsequent paragraphs herein. The two position latch assembly is advantageous over prior art latch assemblies, in that it permits a junction block to be utilized in two separate positions in a raceway, as interconnected to a structural member. For purposes of describing the two position latch assembly in accordance with the invention, the immediately following paragraphs describe certain prior art latch assemblies. One of these assemblies is described with respect to FIGS. 1-5, while the other prior art assembly is described with respect to FIGS. 6 and 6A. Following that description of the prior art latch assemblies, a description of the two position latch assembly in accordance with the invention is set forth herein, with the description referencing FIGS. 7-17.

Figure 1:
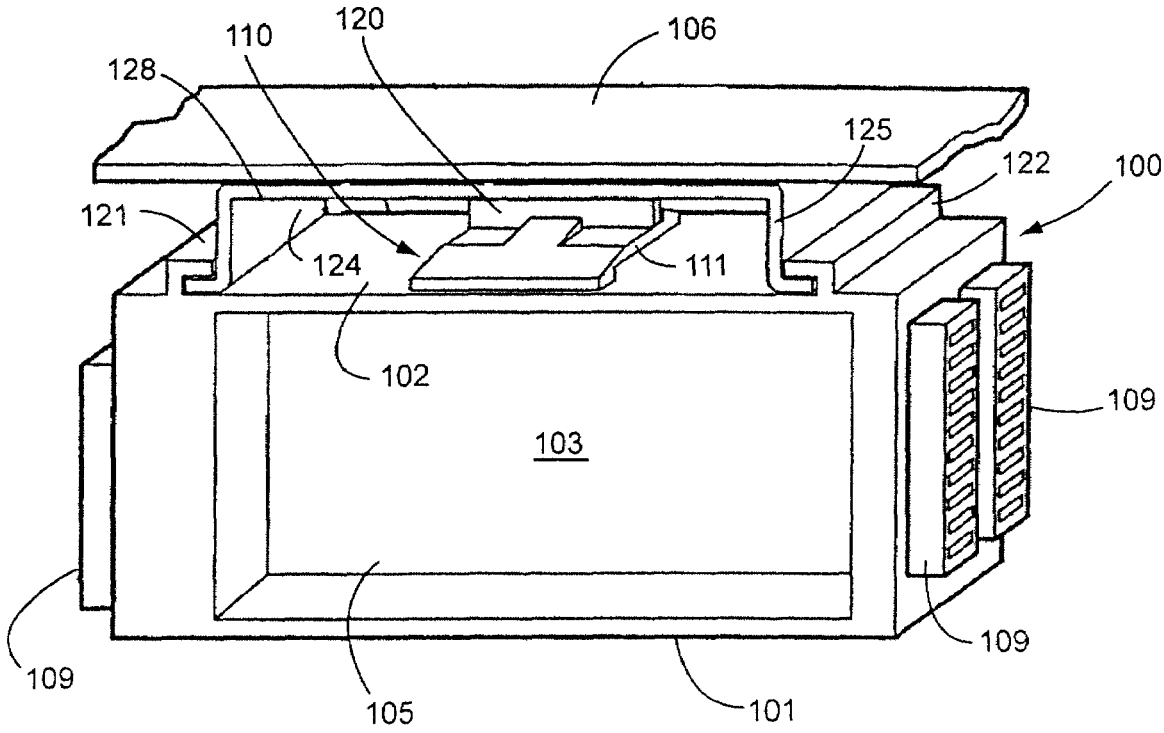
Fig. 1 (Prior Art)
FIG. 1 is a perspective view of a junction block mounted on one type of prior art support structure.

FIG. 1 shows an electrical junction block housing 100 (sometimes referred to herein as the "junction block") supported on a structural member 106 by means of L-shaped mounting lugs 121, 122 on the housing 100. The lugs 121, 122 engage cooperating L-shaped brackets 124, 125 attached to the structural member 106. The structural member 106 may, for example, be the upper wall of a raceway in a wall panel or the like. The junction block housing 100 is provided with a substantially horizontally-extending lower wall 101 and a substantially parallel upper wall 102. A vertical wall 103 extending between the lower wall 101 and the upper wall 102 serves to divide a spatial area 105 from a similar area on the opposite side of wall 103. The spatial areas 105 are typically used to accommodate electrical outlet boxes or the like in the junction block housing. The junction block housing 100 may be connected to electrical circuits by means of electrical connectors 109 in a standard fashion. The junction block housing 100 is maintained in position relative to the structural member 106 by a retaining or "retainer" tab 120 mounted on the structural member 106 and engaging a latching device 110 disposed between mounting lugs 121, 122 on the upper wall 102 of the housing 100. The L-shaped brackets 124, 125 and the tab 120 may be formed with a plate 128 attached to the structural member 106.

Figure 2:
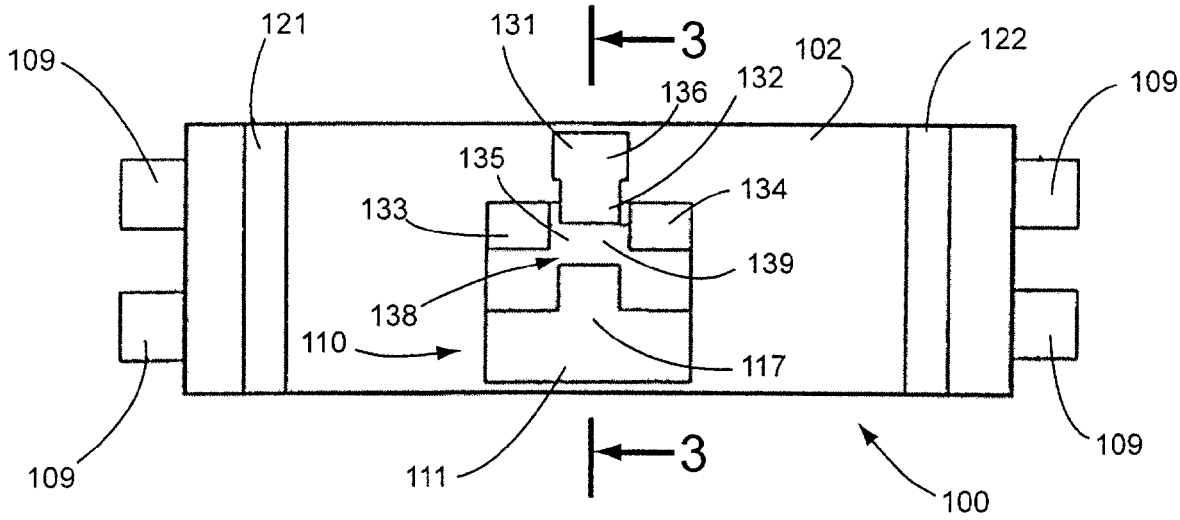
Fig. 2 (Prior Art)
FIG. 2 is a top plan view of a junction block incorporating a prior art latching mechanism.
Figure 3:
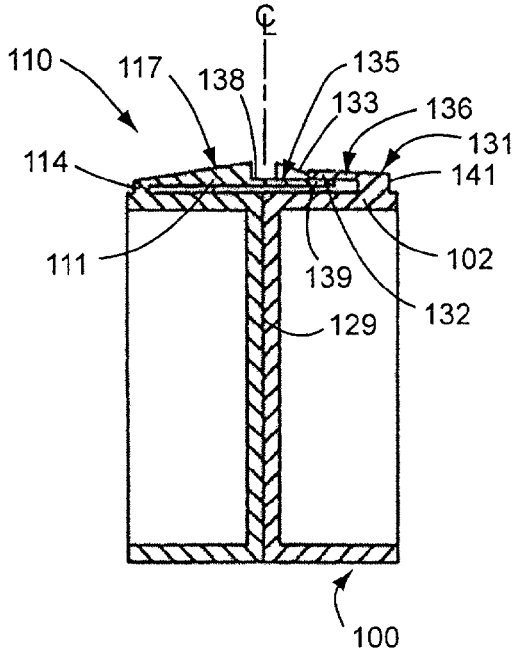
Fig. 3 (Prior Art)
FIG. 3 is a cross-sectional view along line 3-3 of FIG. 2.

FIG. 2 is a top plan view of the junction block housing 100 removed from the structural member 106, the plate 128 and the retaining tab 120. The latching device 110 is shown as comprising a first cantilever beam 111 and a second retention beam 131 having an end portion 132 overlapping a portion of the first cantilever beam 111. FIG. 3 is a cross-sectional view of the latch mechanism of FIG. 2, taken along line 3-3. As depicted in the drawing, the first cantilever beam 111 extends from adjacent one side of the housing 100, and has one end attached to a hinged section or "hinge" 114. The first cantilever beam 111 extends toward and past a centerline 129 of the housing 100 and is provided with a first upwardly sloping surface 117, sloping upwardly from the hinge section 114 toward the centerline 129. Second and third raised portions 133 and 134 (only the second raised portion 133 is shown in FIG. 3) slope downwardly from the centerline 129 toward the opposite side of housing 100. A tab channel 138, as shown primarily in FIGS. 2 and 3, is formed between the second and third raised portions 133, 134, and the sloping surface 117 of the first cantilever beam 111. The second retention beam 131 is provided with the end portion 132 overlapping a relatively flat center portion 135 of the first cantilever beam 111, extending between the raised portions 133, 134 of first cantilever beam 111. The end portion 132 of the second retention beam 131 is connected to the upper wall 102 through an interconnection section 139, as depicted in FIG. 3. Although the interconnection section 139 may be characterized as somewhat of a "hinge," the second retention beam 131 is not required to be particularly resilient or otherwise "flexible" in movement, relative to the upper wall 102. In accordance with some of the primary principals of the invention, the second retention beam 131 primarily serves so as to maintain the first cantilever beam 111 in a position which allows for insertion of the junction block housing 100 in a direction from the left hand side to the right hand side as viewed in FIG. 3, relative to positioning of the junction block housing 100 with the retainer tab 120. The second retention beam 131 includes a surface 136, as shown primarily in FIGS. 2 and 3. The surface 136 is positioned in a substantially horizontal plane, and may or may not have somewhat of an upwardly sloping surface, with the slope extending upwardly from the interconnection section 139 toward the centerline 129. The relatively flat center portion 135 of the first cantilever beam 111 terminates in an end portion 139 which extends toward and below the end portion 132 of the second retention beam 131. In fact, the end portion 132 of the second retention beam 131 is exerting downward pressure on the first cantilever beam 111, thereby limiting upward movement of the beam 111. That is, in the configuration shown in FIG. 3, the first cantilever beam 111 will essentially be in a "tensioned" state, such that the first cantilever beam 111 would tend to rotate in a counter clockwise direction (as viewed in FIG. 3) relative to its hinge section 114 if the second retention beam 131 was absent.

As will be apparent from FIGS. 1 through 3, when the housing 100 is inserted from the front side, as depicted in FIG. 1, the tab 120 will first move above the substantially horizontal surface 136 of the second retention beam 131. As previously mentioned, the end portion 132 of the second retention beam 131 is exerting a downward pressure on the free end of the first cantilever beam 111 at the center portion 135 of the first cantilever beam 111. In this manner, the first cantilever beam 111 is being prohibited from any upward movement of the end portion 139, in a manner whereby the end portion 139 would contact the retainer tab 120, thereby preventing any further movement of the junction block housing 100. As the junction block 100 continues to be inserted, the sloping sections 133 and 134 of the first beam 111 will properly engage the retaining tab 120, thereby depressing the first cantilever beam 111. Further movement of the junction block 100 toward retaining tab 120 will result in further depression or downward movement of the first beam 111, in view of the angled or sloping configurations of the sloping sections 133 and 134. When the tab channel 138 formed between the sloping section 117 on the one side and sloping sections 133 and 134 on the other side of the first cantilever beam 111 is in alignment with the retaining tab 120, the resilient first cantilever beam 111 will tend to return to its prior position and the free end of tab 120 will be retained in the tab channel 138. That is, the first cantilever beam 111 will tend to pivot in a counter clockwise direction (as viewed in FIG. 3) about the hinged section 114. This pivotal movement will continue until the flat center portion 135 of the first cantilever beam 111 again engages the substantially horizontal surface 136 of the second retention beam 131. The relative configuration of the first cantilever beam 111 and the second retention beam 131 is such that in this position, the retaining tab 120 is retained in the tab channel 138. The foregoing is a description of the manner in which the junction block housing 100 could be inserted from the front side, as depicted in FIG. 1. This insertion will correspond to insertion of the housing 100 from the left side toward the centerline 129 as viewed in FIG. 3.

When the housing 100 is to be inserted from the opposite side (i.e., from the backside as depicted in FIG. 1, corresponding to insertion from the right side of the centerline 129 as viewed in FIG. 3) such that the sloping surface 117 first engages the retaining tab 120, the first cantilever beam 111 will be increasingly depressed as the tab 120 engages the sloping surface 117, until the tab channel 138 is reached. When the tab channel 138 is reached, the first cantilever beam 111 will tend to return to its prior position, and the free end of tab 120 will be retained within the tab channel 138. Although the first cantilever beam 111 returns to its prior position, it is limited from any further upwardly movement by the second retention beam 131. In accordance with all of the foregoing, the latching device 110 provides for a retaining configuration which allows insertion of the junction block housing 100 from either direction, relative to the centerline 129. In particular, the use of the second retention beam 131 allows for insertion of the junction block housing 100 from the front side (as depicted in FIG. 1), without problems associate with the end portion 139 of the first cantilever beam 111 inappropriately abutting the retaining tab 120 during insertion.

For purposes of removing the housing 100, this removal can be undertaken, in accordance with the invention, from either of the two opposing sides of the support 106 and centerline 129. In either situation for removal, the removal is initiated by depressing or otherwise exerting downward pressure on the first cantilever beam 111. For example, if it is desired to remove the housing 100 from the front side, as depicted in FIG. 1 (corresponding to the left side as viewed in FIG. 3), the housing 100 may be removed by depressing the first cantilever beam 111 by any suitable device (such as a screwdriver or the like) by exerting pressure, for example, on the sloping surface 117. With pressure exerted on the sloping surface 117, the first cantilever beam 111 will be moved downwardly or otherwise depressed, in such a manner that the sloping sections 133 and 134 will be depressed below the bottom of the retaining tab 120, thereby allowing for the junction block housing 100 to be moved toward the left side, as viewed in FIG. 3.

If it is desired to remove the junction block housing 100 from the right side as viewed in FIG. 3 (e.g. from the backside as depicted in FIG. 1), the user will still initiate removal by depression of the first cantilever beam 111 by any suitable device, such as a screwdriver. For example, the user could exert pressure on either of the sloping sections 133 or 134. This downwardly exerted pressure will correspondingly depress the first cantilever beam 111. Depression of the first cantilever beam 111 will allow the uppermost edge of the sloping surface 117 to be positioned below the bottom of the retaining tab 120. In this manner, the junction block housing 100 may then be moved toward the right of the centerline 129 as viewed in FIG. 3. In accordance with the foregoing, and in accordance with the invention, the junction block housing 100, with the latch arrangement as described herein, is not only insertable from either of the two opposing sides of the support 106, but is also removable from either of the two opposing sides of the support 106.

Figure 4:
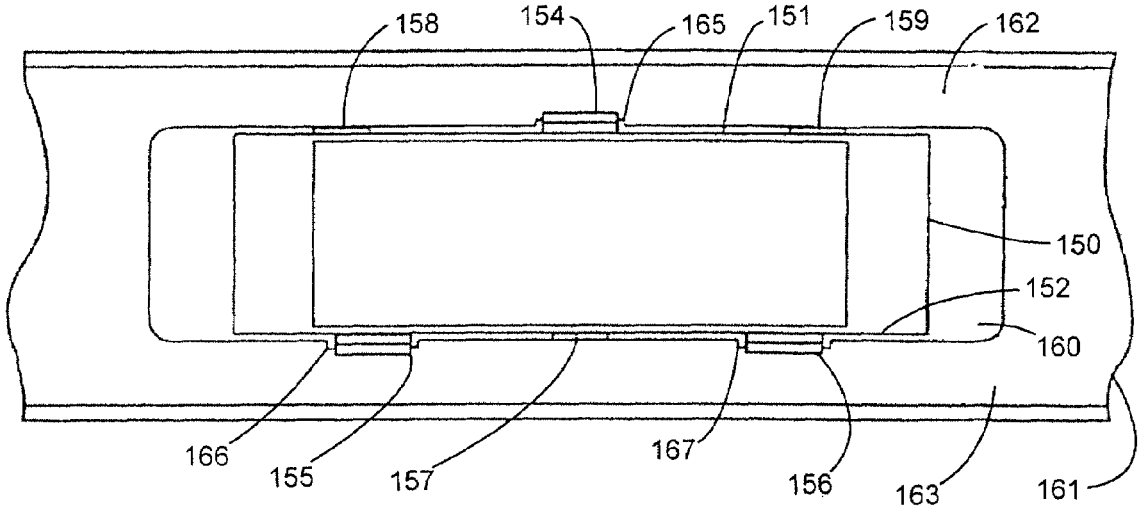
Fig. 4 (Prior Art)
FIG. 4 is a side view of a junction block provided with the latching mechanism mounted on another type of junction block support structure.

FIG. 4 is a side view of a junction block 150 mounted within an opening 160 within a frame or structural member 161. The junction block 150 is provided with an upper wall 151 and a lower wall 152. Mounted on the upper wall is a latch member 154 such as previously described herein with reference to FIGS. 1 through 3. The latch member 154 is positioned for engagement with an upper rail 162 of the structural member 161. Further latching members 155 and 156 are mounted on the lower wall 152 and are positioned for engagement with a lower rail 163 of the structural member 161. The upper rail 162, in this particular example, is provided with a detent 165 in the area where the latching member 154 engages the upper rail. Similarly, the lower rail 163 is provided with detents 166 and 167 in the vicinity of latching members 155 and 156, respectively. One or more of these detents may be conveniently provided to prevent lateral movement of the junction block. A pair of spacing shoulders 158, 159, may be provided on upper wall 151 to reduce movement of the junction block and to better secure the junction block between the upper and lower rails 162, 163. A similar shoulder 157 may be provided on the lower wall 152.

Figure 5:
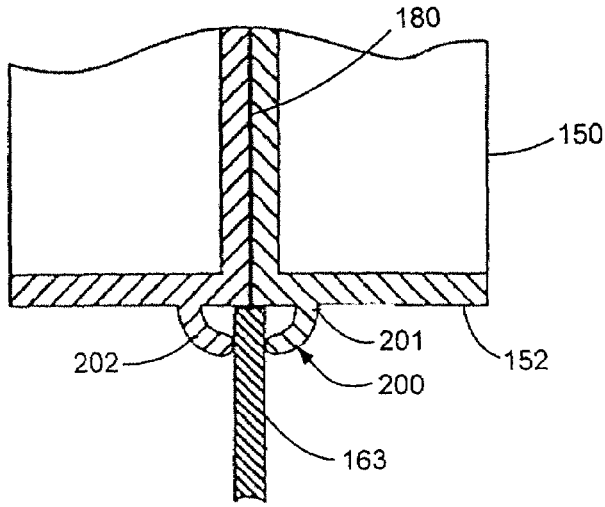
Fig. 5 (Prior Art)
FIG. 5 is a partial cross-sectional view of a lower part of the junction block of FIG. 4, provided with a lower tab for engagement with a lower rail depicted in FIG. 4.

Alternatively, one of the walls 151, 152 may be provided with one or more engagement tabs, such as tab 200 shown in FIG. 5, such that one or more of the latch members as depicted in FIGS. 1 through 3 would be formed on only the other of the walls 151, 152. As an example, FIG. 5 shows a cross-sectional view of an alternate embodiment employing an engagement tab 200 on one of the walls of the junction block 150 generally depicted in FIG. 4. By way of example, the junction block 150 may be provided with a latch member 154 on its upper wall 151 and a tab 200 on its lower wall 152. The tab 200 is provided with a pair of arcuate arms 201, 202 which are spaced apart to allow tab 200 to extend over a portion of the lower rail 163. In this manner, tab 200 serves to retain block 150 in proper position relative to lower rail 163 while allowing a pivoting of block 150 during insertion and removal. One or more spacing shoulders, such as shoulders 158, 159, may be used on the upper wall 151 of housing 150. However, a spacing shoulder on the lower surface 152, such as shoulder 157 shown in FIG. 4, will generally not be used with tab 200.

In accordance with the foregoing, a mounting assembly is provided which allows a junction block housing to be readily engaged and disengaged from either side of a wall panel or other device to which a support for the junction block housing is attached. Mounting assemblies in accordance with the invention also facilitate ease of insertion and removal of the junction block housings. Still further, mounting assemblies in accordance with the invention overcome the problems of prior art systems which tend to bind during engagement and disengagement.

Figure 6:
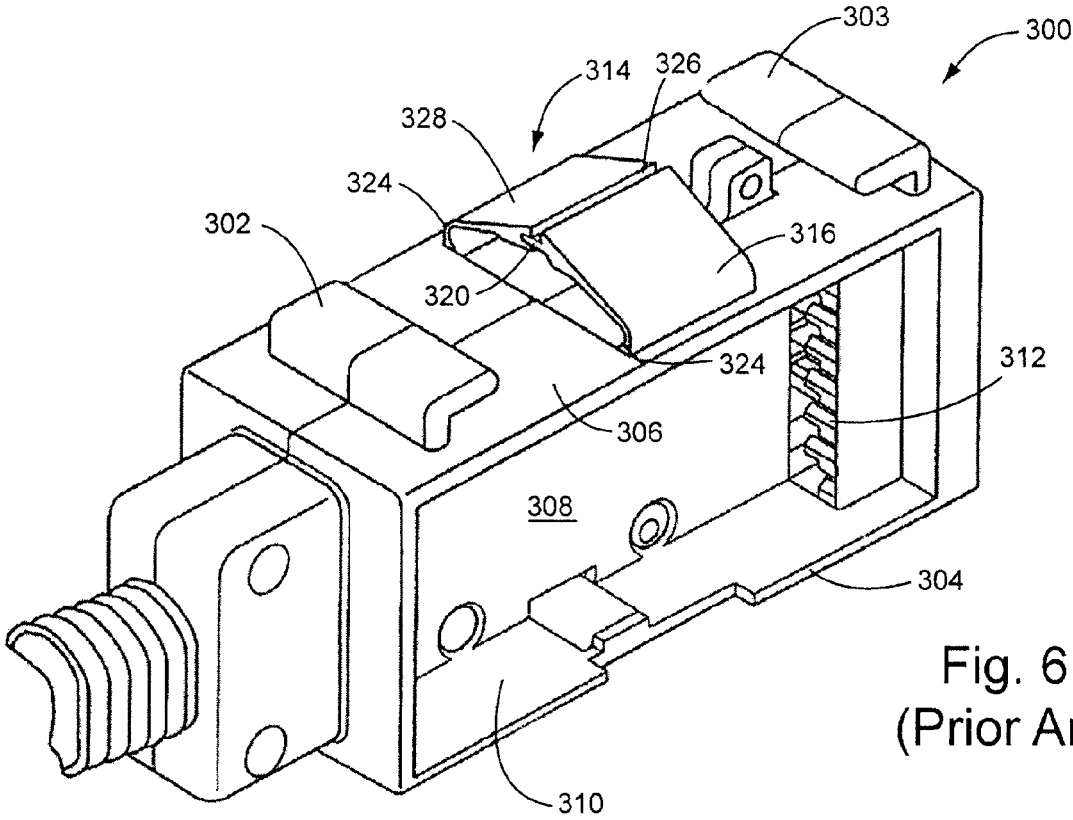
Fig. 6 (Prior Art)
FIG. 6 is a perspective view of a junction block having another type of prior art latching mechanism incorporated thereon.
Figure 6A:
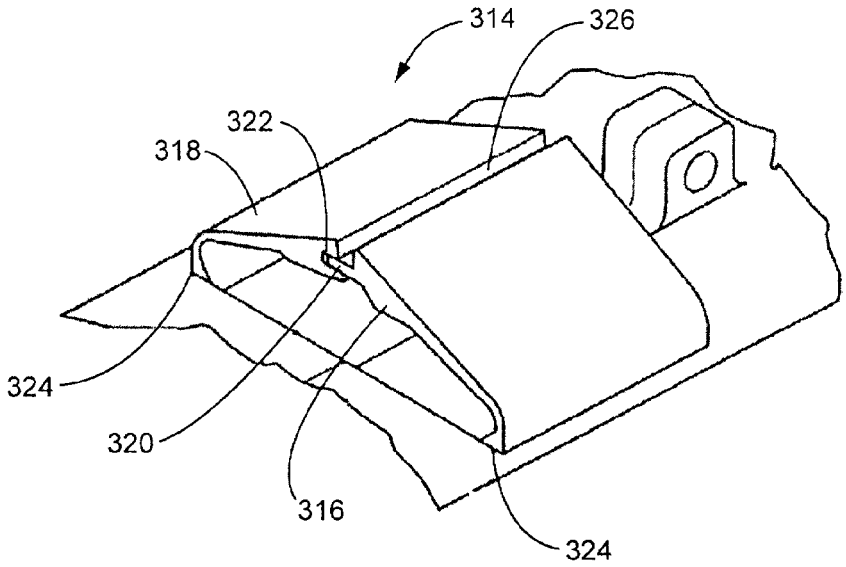
Fig. 6A (Prior Art)
FIG. 6A is an enlarged, perspective view of the prior art latching mechanism illustrated in FIG. 6.

A further prior art latch assembly is illustrated with respect to FIGS. 6 and 6A. Therein, a prior art junction block housing 300 is illustrated, with the housing attached to a structural member (not shown) by means of L-shaped mounting lugs 302 and 303. These mounting lugs 302, 303 would engage correspondingly L-shaped support brackets (not shown) associated with a structural member (not shown). The structural member may, for example, be the upper wall of a raceway in a wall panel or the like. The housing 300 is provided with a substantially horizontally-extending lower wall 304 and a substantially parallel upper wall 306. A vertical wall 308 extending between the lower wall 304 and the upper wall 308 serves to divide a spacial area 310 from a similar area on the opposite side of the vertical wall 308. The spacial areas 310 are typically used to accommodate electrical outlet receptacle blocks on the like in the junction block housing. The junction block housing 300 may be connected to electrical circuits by means of electrical connector 312 in a standard fashion. The junction block housing 300 is maintained in a desired position relative to a structural member by a retaining or "retainer" tab (not shown) mounted on the structural member and engaging a latching device 314 disposed between the mounting lugs 302, 303 on the upper wall 306 of the housing 300. Such L-shaped brackets and retainer tab may be formed with a plate or the like attached to a structural member.

Turning in particular to FIG. 6A, the latching device 314 includes interlocking latch members comprising a first cantilever beam 316 and a second retention beam 318. The first cantilever beam 316 is provided with an elongated member such as the tongue 320. Correspondingly, the second retention beam 318 is provided with an appropriate opening, such as a groove 322 to receive the tongue 320. The interlocking first cantilever beam 316 and second retention beam 318 are hinged at hinge points 324. Preferably, the beams 316, 318 are constructed of a resilient plastic material, which provides a restoring force on the interlocking latch members. A channel 326 is defined by the beams 316, 318 for engaging the retainer tab. The latching device 314 may be disengaged from the retainer tab by depressing either the first cantilever beam 316 or the second retention beam 318. Depressing of either beam will cause both of the beams 316, 318 to be depressed and further cause the retainer tab to be disengaged from the channel 326. The junction block 300 may then be removed from support brackets (not shown) on a structural member by depressing either the first cantilever beam 316 or the second retention beam 318, and sliding the housing 300 on the support brackets in either direction. Similarly, during installation, sliding motion on the support brackets will result in engagement of the latching device 314 with the retainer tab, causing both of the beams 316, 318 to be depressed until the retainer tab is aligned with the channel 326. At that point, the restoring force imparted to the latching device 314 due to the resiliency of the beams 316, 318 will cause engagement of the channel 326 with the retainer tab, thereby placing the housing 300 in a locked positioned.

With respect to the prior art latching configurations described herein, one potential disadvantage may exist. Specifically, with either of the prior art latching mechanisms described herein, it is apparent that the mechanisms can accommodate structural members and retainer tabs only of one size. Accordingly, if one of the prior art junction block housings was to be used in raceways of different sizes, differing junction block housings would be required.

In contrast, and in accordance with the invention, a latch assembly is described herein which provides for two positions to be utilized with respect to the interlocking relationship between a latch assembly and a retainer tab.

Figure 7:
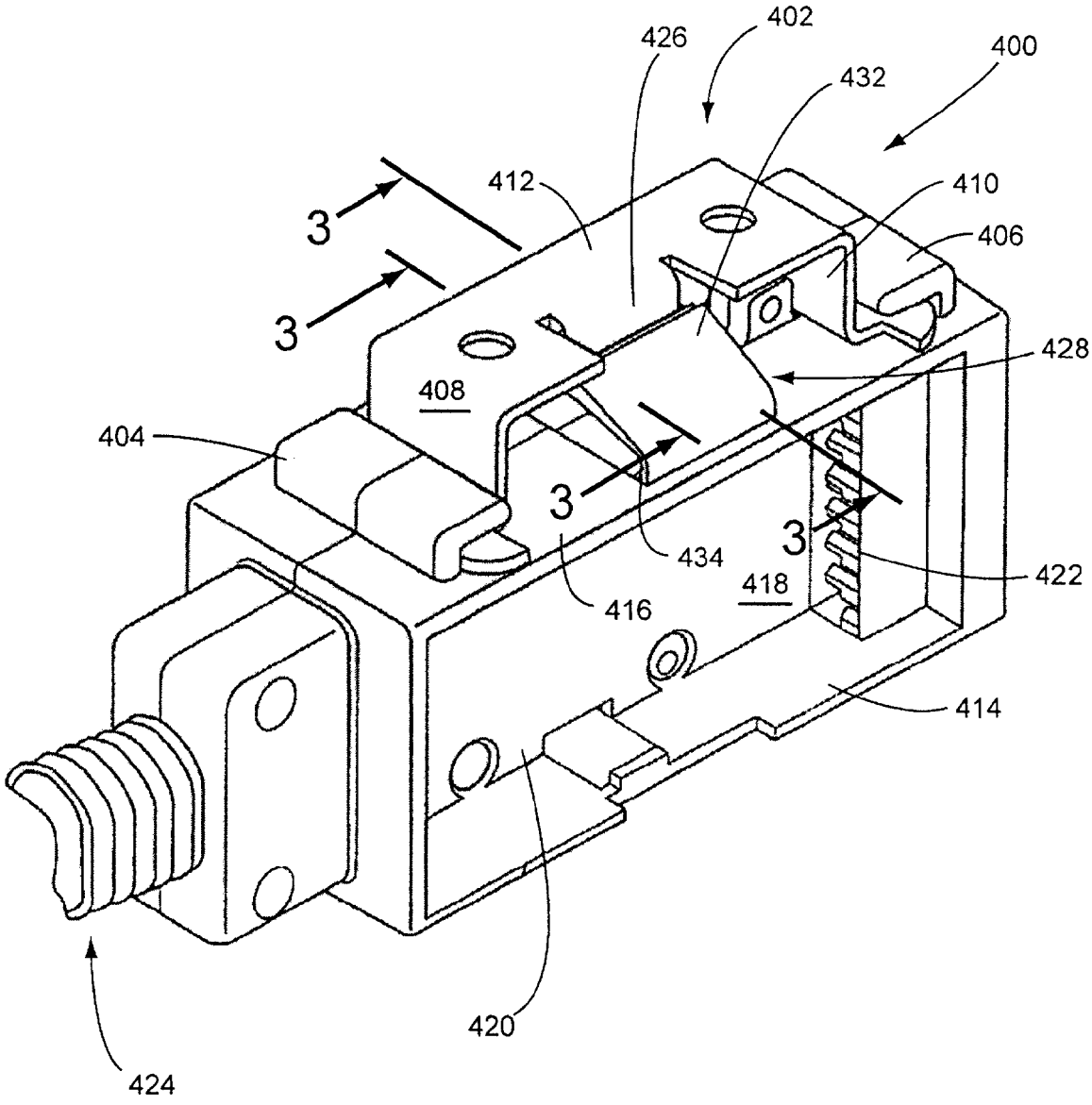
FIG. 7 is perspective view of a junction block mounted to a structural member and having a latch assembly in accordance with the invention.
Figure 7A:
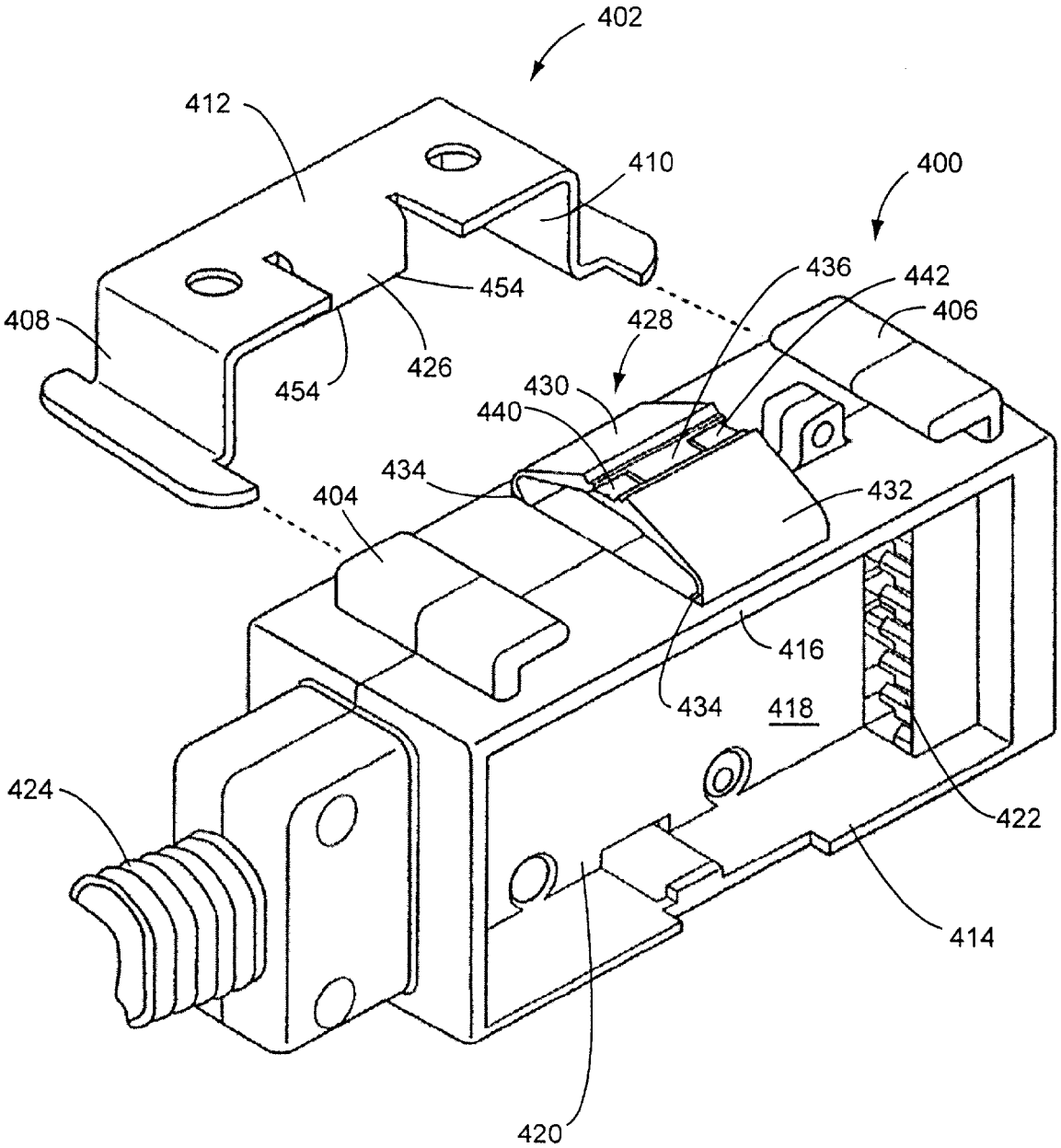
FIG. 7A is an exploded view illustrating the interconnecting relationship between the structural member and the junction block illustrated in FIG. 7.

More specifically, FIGS. 7 and 7A illustrate an illustrative embodiment of the invention in which an electrical junction block housing 400 (sometimes referred to as the "junction block") is supported on a structural member 402 by means of L-shaped mounting lugs 404, 406 on the housing 400. The lugs 404, 406 engage cooperating L-shaped brackets 408, 410 attached to the structural member 402. The structural member 402 may, for example, be a metal bracket attached to an upper wall of a raceway in a wall panel or the like. Correspondingly, the structural member 402 may, in fact, comprise part of a raceway upper wall itself. The junction block housing 400 is provided with a substantially horizontally-extending lower wall 414 and a substantially parallel upper wall 416. A vertical wall 418 (or a pair of vertical walls 418) extending between the lower 414 and the upper wall 416 serves to divide a spacial area 420 from a similar area on the opposite side of the vertical wall 418. The spacial areas 420 are typically used to accommodate electrical outlet receptacle blocks or the like (not shown) in the junction block housing 400. The junction block housing 400 may be connected to electrical outlet receptacle blocks or the like by means of electrical connectors 422 in a standard fashion. Correspondingly, as also shown in FIG. 7, power may be supplied to the junction block housing by means of an incoming power cable 424.

The junction block housing 400 is maintained in a position relative to the structural member 402 by means of a retaining or "retainer" tab 426 mounted on the structural member 402, or otherwise formed integral therewith. As will described in subsequent paragraphs herein, the retainer tab 426 engages a latching device or latch assembly 428 disposed between the mounting lugs 404, 406 on the upper wall 416 of the housing 400. In the particular configuration shown herein, the L-shaped brackets 408, 410 are actually formed integral with the horizontal section 412 so as to form the structural member 402. In addition, the retainer tab 426 is also formed as an integral part of the horizontal section 412 and L-shaped brackets 408, 410. Details of the structural member 402 are shown in the stand alone drawings of the same in FIGS. 12 and 13. The general structural interconnection of the structural member 402 to the junction block housing 400 is illustrated in the exploded view of FIG. 7A.

The latch assembly 428 is illustrated in a number of the drawings, including FIGS. 7A, 8-11 and 14-17. The latch assembly 428 is shown therein as comprising a first cantilever beam 430 and a second cantilever beam 432. The cantilever beams 430 and 432 are hinged to opposing bottom portions of the structural member 402 at hinge points 434. The hinge points 434 are preferably constructed of a resilient plastic material, which provides a restoring force on the cantilever beams 430, 432. The first cantilever beam 430 extends from its hinge point 434 toward a centerline of the housing 400, and is provided with a sloping center extension 436 which is shown particularly in FIGS. 15 and 17. The center extension 436 extends beyond the centerline and may be integral with the remaining portion of the first cantilever beam 430. Correspondingly, the second cantilever beam 432 also extends from its hinge point 434 toward a centerline of the housing 400. At the sides of the forwardmost surface of the second cantilever beam 432 are a pair of opposing lateral extensions 438. These extensions 438 are identified as a first lateral extension 440 and a second lateral extension 442. As with the remaining portion of the second cantilever beam 432, the lateral extensions 438 are also resilient and capable of deflection. The lateral extensions 440 and 442 both extend from the second cantilever beam 432 beyond the centerline and may be integral with main portions of the second cantilever beam 432.

Figure 8:
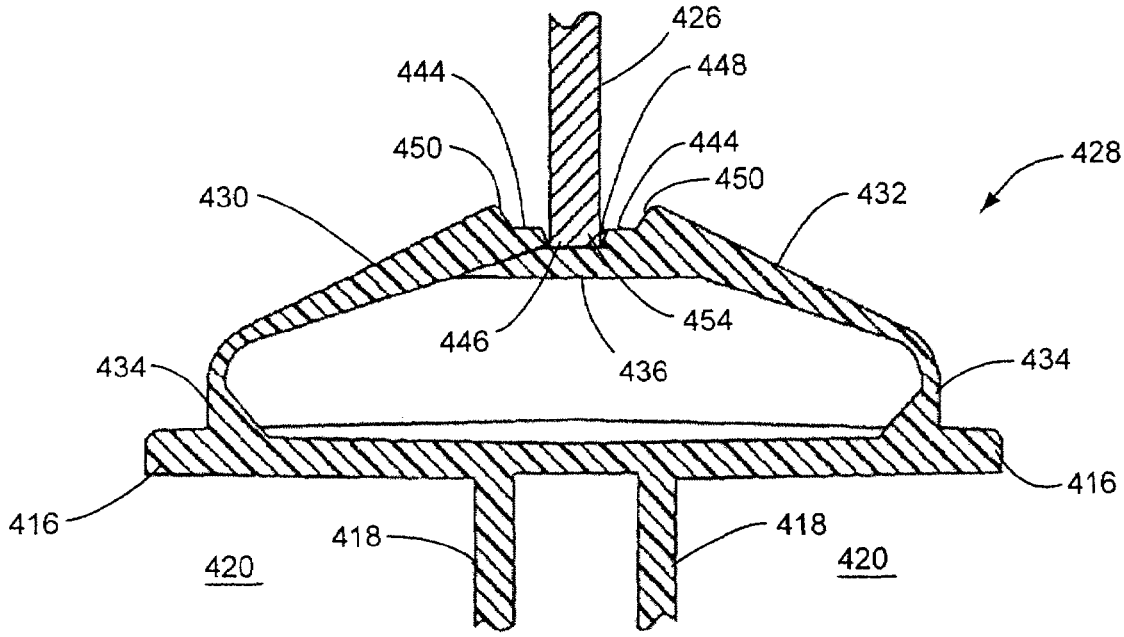
FIG. 8 is a sectional, side view illustrating an interconnection relationship between the latch assembly and a retainer tab of the structural member, when the structural member is "locked" to the latch assembly in a first position, and is taken along section lines 8-8 of FIG. 7.
Figure 9:
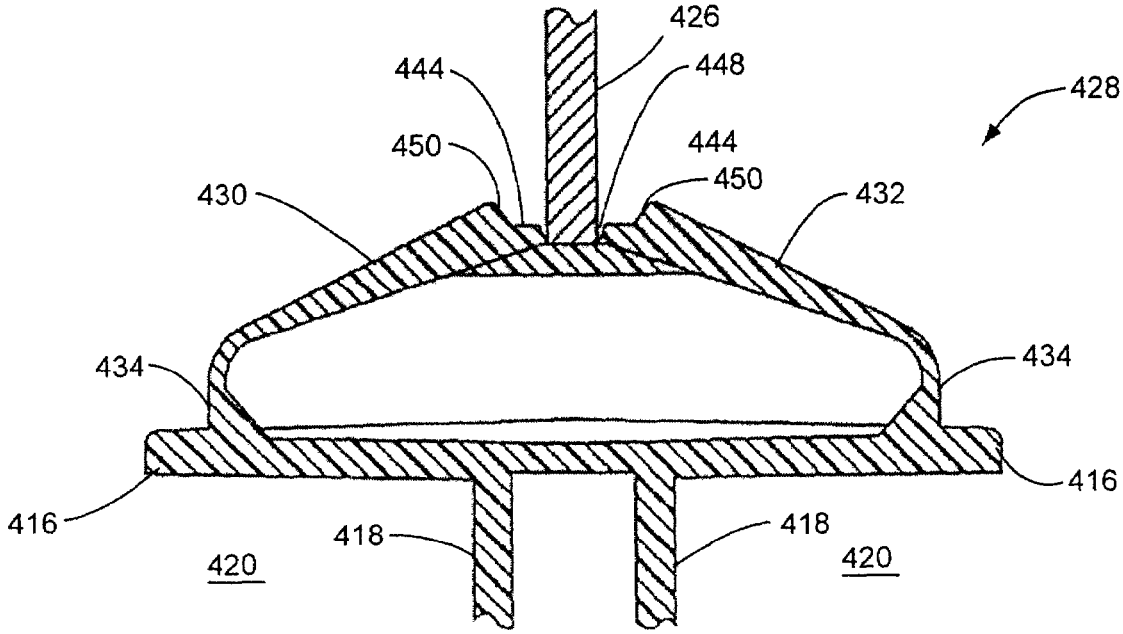
FIG. 9 is a view similar to FIG. 8, but taken along section lines 9-9 of FIG. 7.

As primarily shown in FIGS. 8-11, the forward portions of the first cantilever beam 430 and second cantilever beam 432 form a first ledge set 444. Correspondingly, the first ledge set 444 and top surfaces 446 of the center extension 436 and lateral extensions 438 form a first channel 448. This channel 448 is illustrated in FIGS. 8 and 9, with the retainer tab 426 being engaged in the first channel 448. As described in subsequent paragraphs herein, this interlock position is characterized as the "first interlocking position" for the retainer tab 426 and the latch assembly 428.

Figure 10:
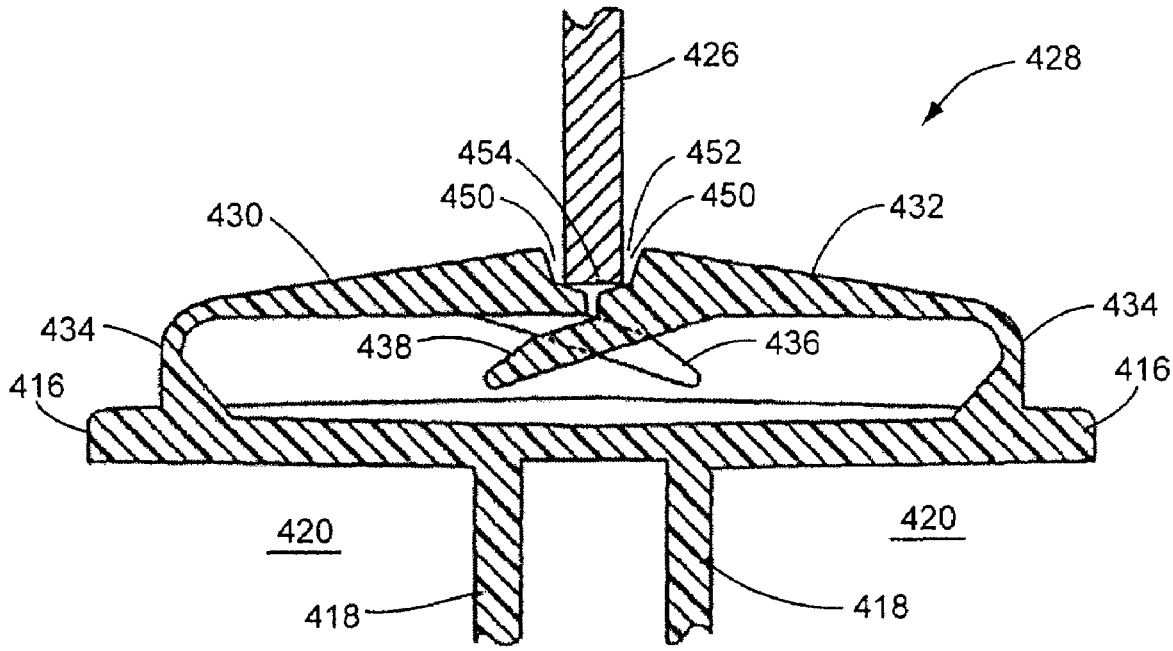
FIG. 10 is a sectional, side view similar to FIG. 8, but illustrating the relative positions of elements of the latch assembly and the retainer tab when the latch assembly is in a second or position.
Figure 11:
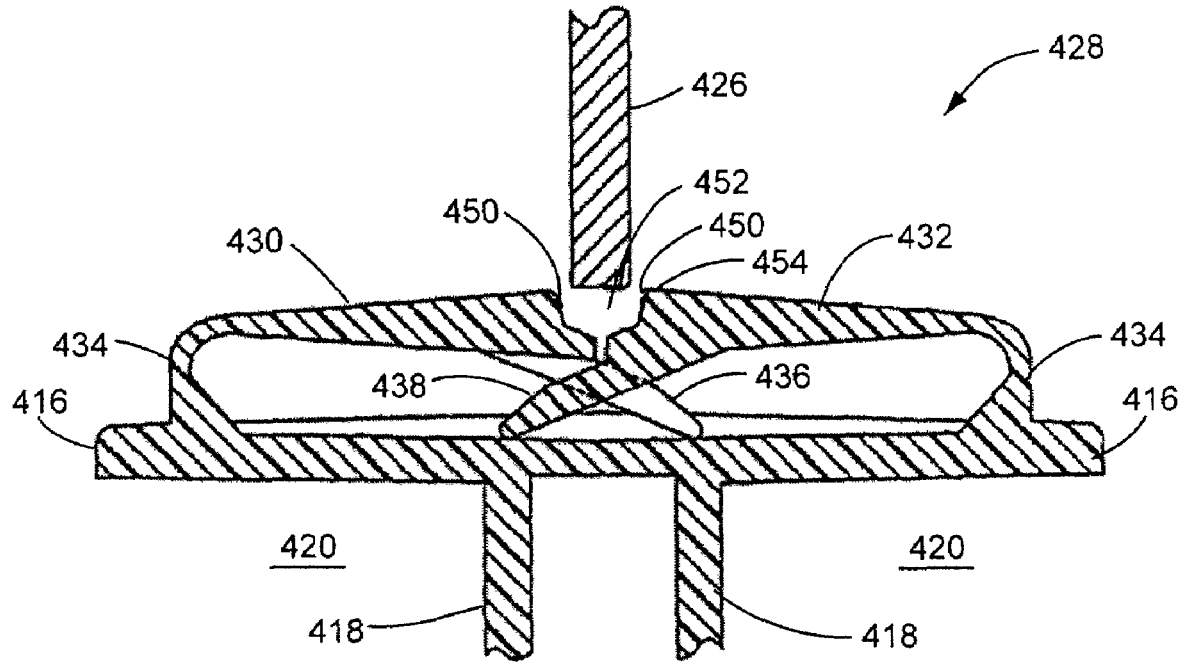
FIG. 11 illustrates the relative positioning of the latch assembly elements, when the latch assembly is depressed to its full release position so as to disengage the retainer tab from the latch assembly.
Figure 12:
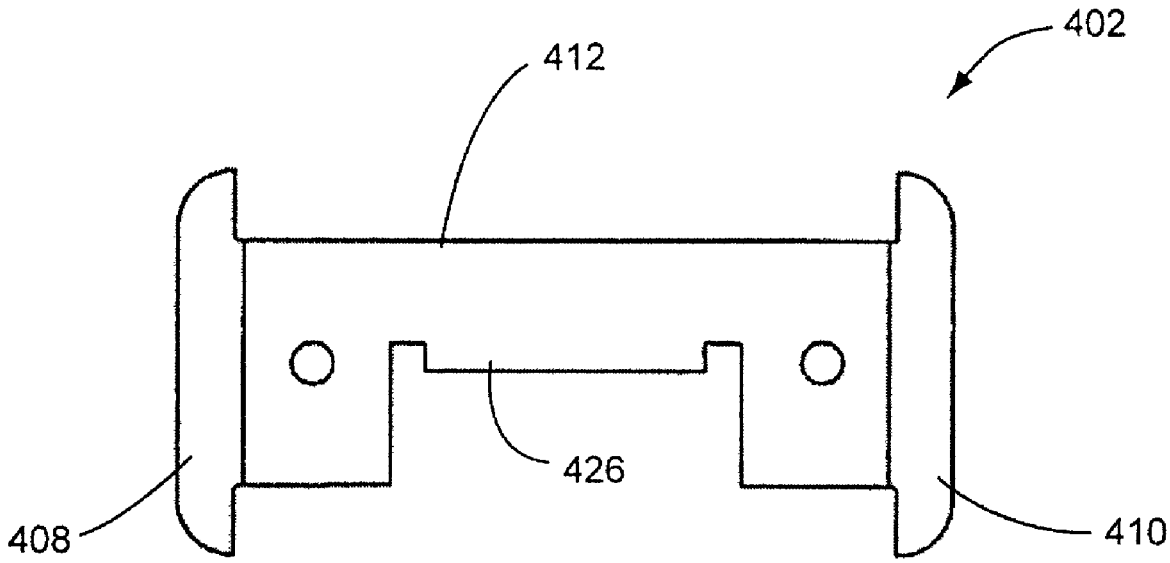
FIG. 12 is a plan view of a structural member which may be utilized in accordance with the invention.
Figure 13:
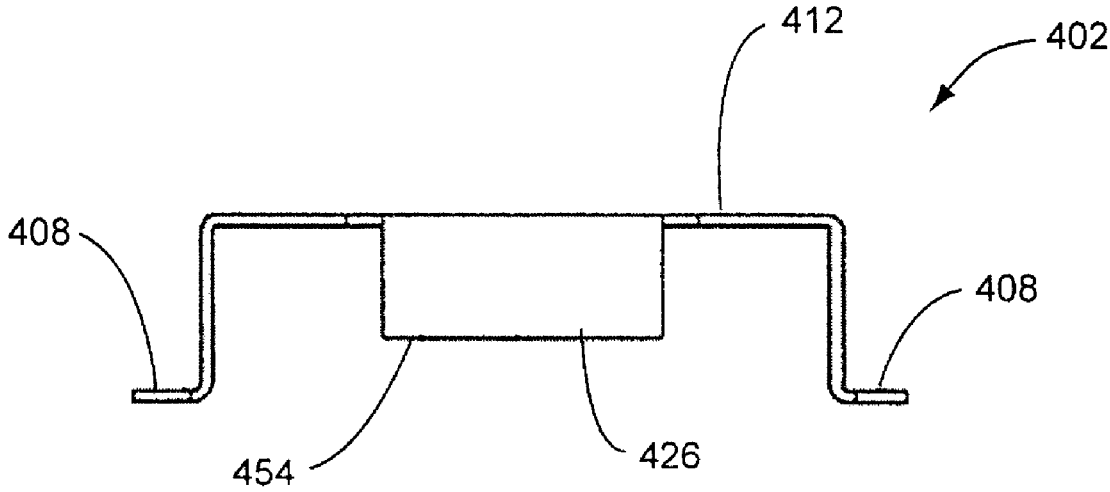
FIG. 13 is a front, elevation view of the structural member illustrated in FIG. 12.
Figure 14:
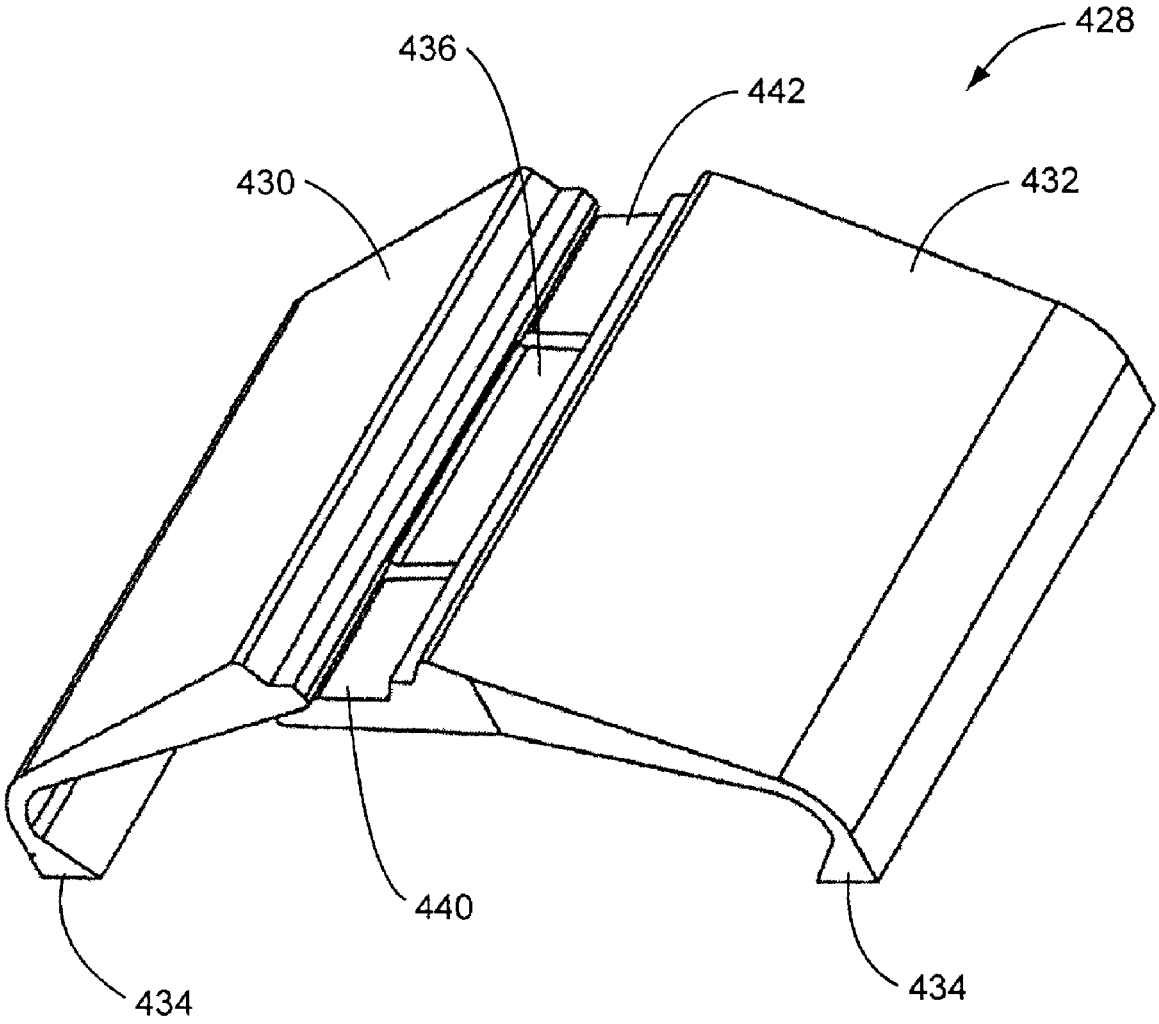
FIG. 14 illustrates a perspective view of the latch assembly, when the assembly is in its first position.
Figure 15:
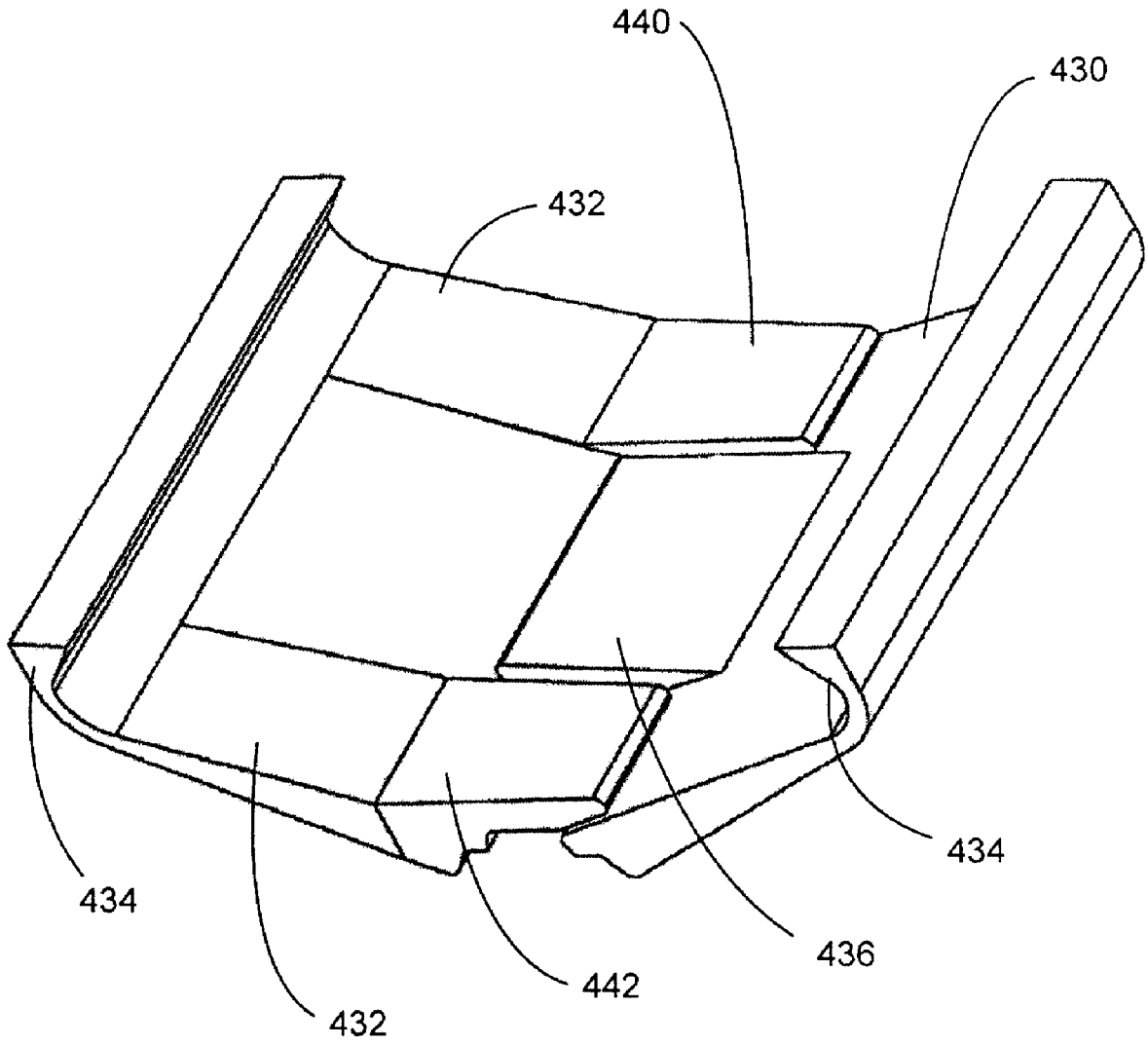
FIG. 15 is an underside, perspective view of the latch assembly illustrated in FIG. 14 in its first position.
Figure 16:
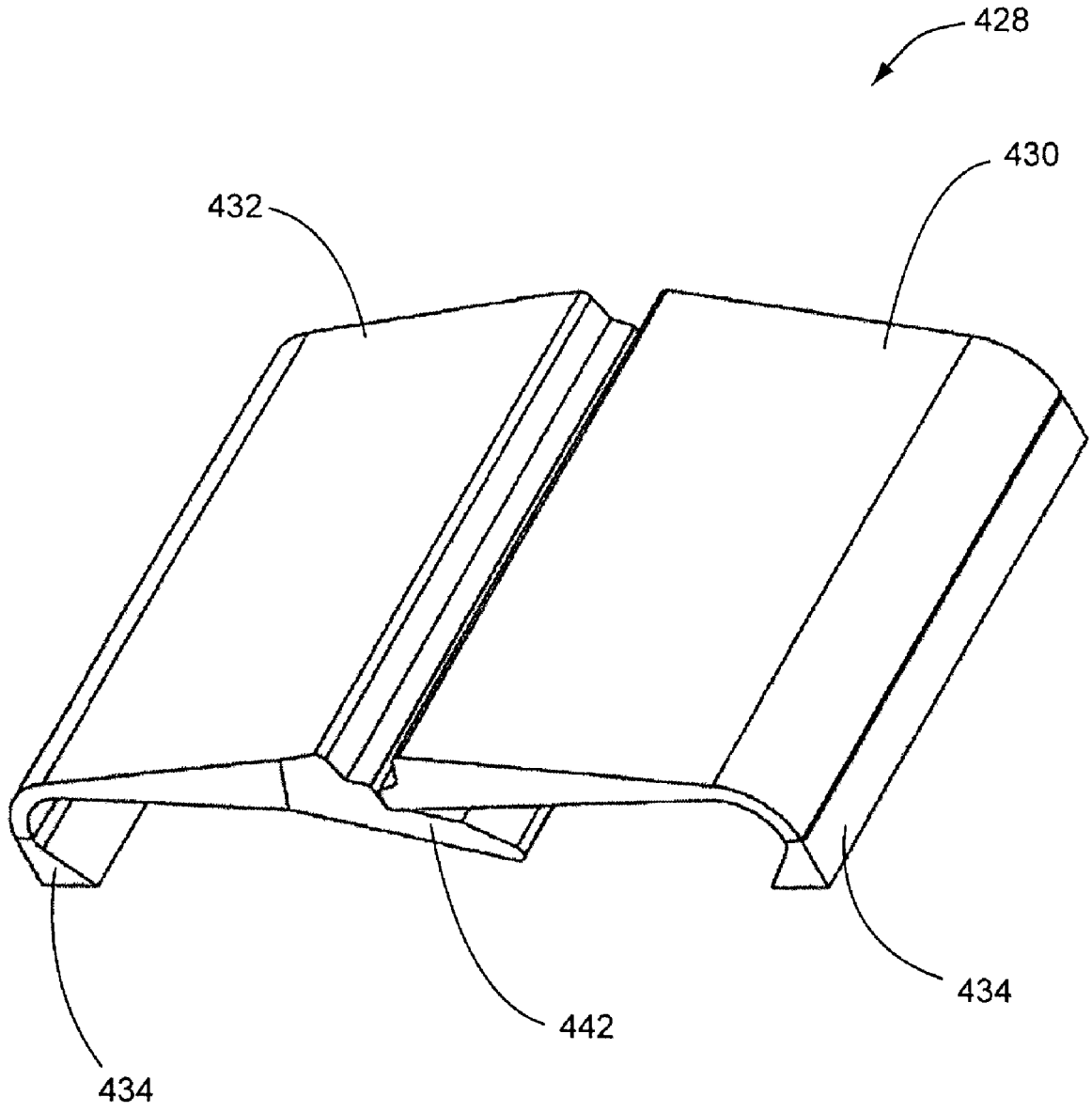
FIG. 16 is a perspective view of the latch assembly, with the assembly in its second position.
Figure 17:
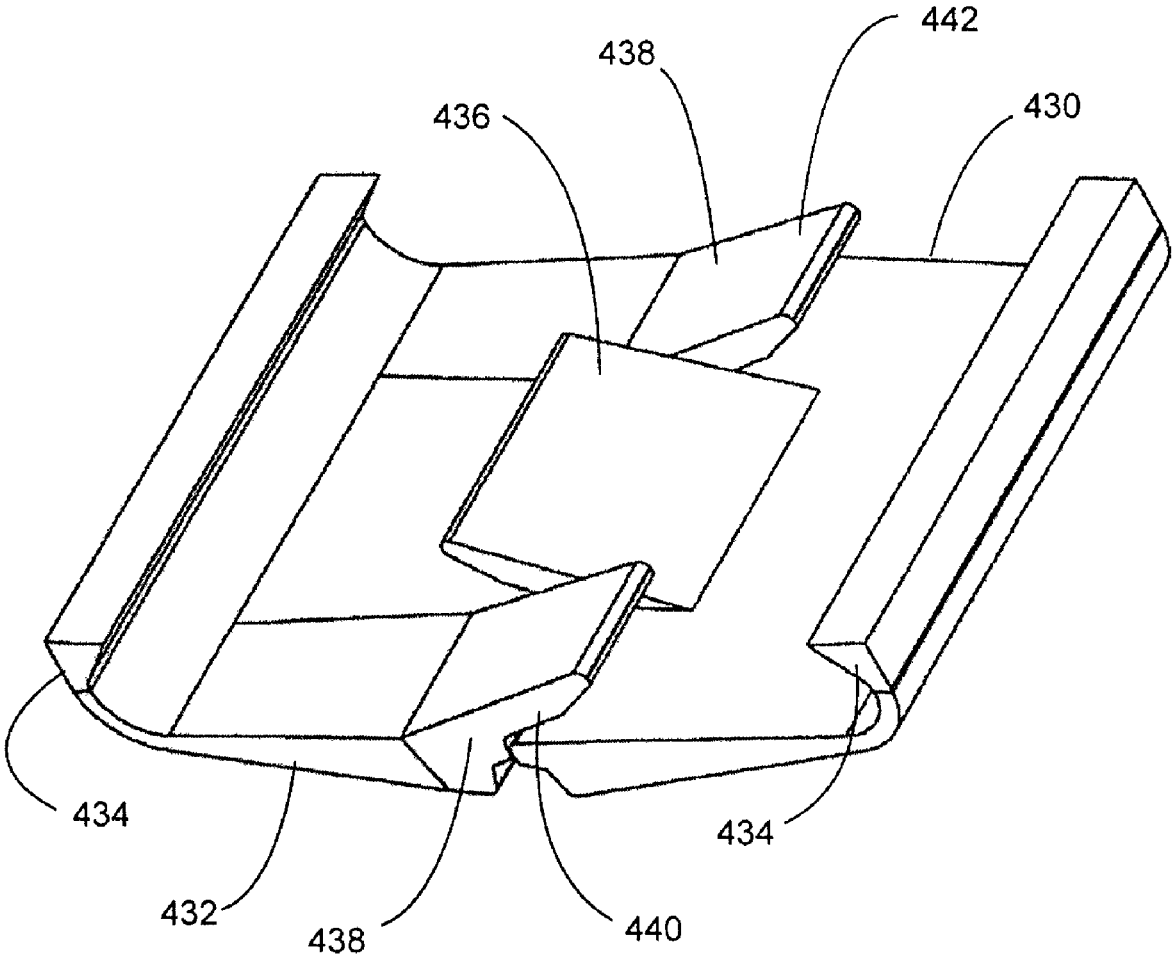
FIG. 17 is an underside, perspective view of the latch assembly illustrated in FIG. 16, in its second position.

With further reference particularly to FIG. 10, the first cantilever beam 430 and second cantilever beam 432 form, at their extended ends, a pair of ledge surfaces 450. As further shown in FIG. 10, these ledge surfaces 450, assuming that the first cantilever beam 430 and second cantilever beam 432 are in the positions illustrated in FIGS. 10 and 11, form a second channel 452.

The operation of the latch assembly 428, with respect to interlocking of the retainer tab 426 of structural member 402, will now be described, primarily with respect to FIGS. 7-17. First, it will be assumed that the relative position of the junction block housing 400 and the structural member 402 is as shown in FIG. 7*a*. Further, it can be assumed that the structural member 402, as earlier described herein, is secured to a support plate at the top of a raceway in an office panel, or otherwise secured to the top of the raceway itself. With this stationary configuration of the structural member 402, it is further assumed that the retainer tab 426 has a length which terminates at its lower end as primarily shown in FIGS. 8 and 9. With reference first to FIG. 7*a*, when the housing 400 is moved toward the structural member 402, the L-shaped brackets 408, 410 will be received within the L-shaped mounting lugs 404, 406, respectively. Correspondingly, the lower edge 454 of the retainer tab 426 will being to abut the sloping upper surface of the first cantilever beam 430. This abutment will cause the retainer tab 426 to exert a downward pressure on the upper surface of the beam 430, so as to cause the beam 430 to flex downwardly. This downward flexion will continue to occur until the lower edge 454 of the retainer tab 426 passes the ledge surface 450 of the first cantilever 430. With the relative configurations of the center extension 436 and the lateral extensions 438, the beams 430 and 432 will form the first channel 448, with a width sufficient so that the lower edge 454 of the retainer tab 426 is captured within this first channel 448. This configuration is illustrated in both FIGS. 8 and 9.

In accordance with the foregoing description, the first channel 448 and the relative sizing of the retainer tab 426 and the beams 430, 432 are sufficient so as to allow capture of the retainer tab 426 of a particular length. However, as previously described herein, one of the primary concepts in accordance with the invention is that the latch assembly 428 is constructed so as to allow for a retainer tab which is longer in length, relative to the positioning of the junction block housing 400. This relatively longer retainer tab 426 is illustrated in FIG. 10. More specifically, with this relatively longer retainer tab 426, when the retainer tab 426 passes over the ledge surface 450 of the first cantilever beam 430, the lower edge 454 will extend low enough so that the beams 430 and 432 form the second channel 452. Correspondingly, with the relative length of the retainer tab 426, the lower edge 454 of the retainer tab 426 is captured within the second channel 452. In this manner, the beams 430 and 432, with their center extension 436 and lateral extensions 438, cooperate so as to capture the retainer tab 426 within the second channel 452.

In accordance with the foregoing, the latch assembly 428, also in accordance with the invention, can be characterized as a "two position" latch assembly, in that it can capture retainer tabs 426 of different lengths, through the configurations which serve to form either a first channel 448 or a second channel 452. The channels 448, 452 are formed based upon the relative length of the retainer tab 426, and the position of the lower edge 454 of the retainer tab 426 relative to the cantilever beams 430, 432.

To release or disengage the retainer tab 426 from the latch assembly 428, and assuming that the retainer tab 426 is in the position shown in FIG. 8, or in the position shown in FIG. 10, downward pressure may be exerted by a user on the upper surface of the first cantilever beam 430, or the upper surface of the second cantilever beam 432. With the interlocking engagement of the cantilever beams 430, 432 as a result of the configurations of the center extension 426 and the lateral extensions 438, downward pressure exerted on either the first cantilever beam 430 or the second cantilever beam 432 will cause these beams 430, 432 to move downwardly, up to the extent illustrated in FIG. 11. This position can be characterized as the "full release" position. With the cantilever beams 430, 432 in the full release position, it is apparent from FIG. 11 that the lower edge 454 of the retainer tab 426 is above the upper surfaces of the beams 430, 432. Accordingly, the junction block housing 400 can then be slid outwardly (in either direction) from the structural member 402. In this manner, the housing 400 can be removed from the attendant raceway or the like.

The configurations shown for the latch assembly 428 in accordance with the invention permit the retainer tab 426 to be captured in either one of two relative configurations of the latch assembly 428. A first one of the configurations is illustrated in FIG. 8, while a second configuration is illustrated in FIG. 10. From the remainder of the drawings and the foregoing description, it is shown and described that these configurations are provided, in substantial part, by the relative sizing and configurations of the center extension 436 and the lateral extensions 438. As shown, for example, in FIG. 17, the configurations are provided in part by the center extension 436 associated with the first cantilever beam 430 overlapping the second cantilever beam 432. Correspondingly, the first lateral extension 440 and the second lateral extension 442 associated with the second cantilever beam 432 are made to overlap the first cantilever beam 430. It is this configuration and the relative sizing of the beams 430, 432 which permit the "two position" configuration for the latch assembly 428 and the retainer tab 426.

It will be apparent to those skilled in the pertinent arts that still other embodiments of latch assemblies in accordance with the invention can be designed. That is, the principles of a latch assembly in accordance with the invention are not limited to the specific embodiments described herein. Accordingly, it will be apparent to those skilled in the art that modifications and other variations of the above-described illustrative embodiments of the invention may be effected without departing from the spirit and scope of the novel concepts of the invention.

The embodiments of the invention in which an exclusive property or privilege is claimed are defined as follows:

1. An electrical connection member for mounting on a structural support member, the electrical connection member comprising a housing having an outer wall with spaced apart first and second opposite side edges disposed equidistant from a longitudinally extending centerline of the housing and a latch member disposed on the outer wall for engagement with the structural support member, the latch member comprising:

a first cantilever beam connected to said housing on an upper surface thereof, said first cantilever beam having a proximal end hingedly attached to said outer wall at a first cantilever beam hinged location disposed between said centerline and said first side edge;

said first cantilever beam coupled to a center extension extending from an edge of said first cantilever beam disposed between said centerline and said first side edge, with said center extension having a free distal end terminating between said centerline and said second side edge;

a second cantilever beam connected to said housing and having a proximal end hingedly attached to said outer wall at a second cantilever beam hinge location disposed between said centerline and said second side edge; and said second cantilever beam having at least a pair of lateral extensions, each of said lateral extensions having a proximal end secured to said second cantilever beam at a location disposed between said centerline and said second side edge, and extending to and terminating at a free distal end, said free distal end terminating between said second centerline and said first side edge.

2. An electrical connection member in accordance with claim 1, characterized in that said latch member comprises first capturing means for capturing a lower terminating end of a vertically disposed retainer tab at a first captured position, said first captured position resulting in said lower terminating end of said retainer tab being positioned a first length above said outer wall.

3. An electrical connection member in accordance with claim 2, characterized in that said latch member further comprises second capturing means associated with said first and second cantilever beams, for capturing said lower end of said retainer tab at a second captured position, said second captured position having said lower end of said retainer tab being a second length above said outer wall, said first length being different than said second length.

4. An electrical connection member in accordance with claim 3, characterized in that said first capturing means is formed as a first channel from top surfaces of said center extension and said lateral extensions, and a first ledge set comprising a pair of ledges forming said first channel and integral with said center extension and said lateral extensions.

5. An electrical connection member in accordance with claim 3, characterized in that said second capturing means is formed as a second channel, said second channel being formed by a pair of ledged surfaces integral with said center extension and said lateral extensions.

6. An electrical connection member in accordance with claim 3, characterized in that said retainer tab is releasable from said first capturing means and said second capturing means by a user exerting downward pressure on either said first cantilever beam or said second cantilever beam, so as to cause said first cantilever beam and said second cantilever beam to move to a full release position.

* * * * *

UNITED STATES PATENT AND TRADEMARK OFFICE

CERTIFICATE OF CORRECTION

PATENT NO. : 7,534,122 B2
APPLICATION NO. : 11/912573
DATED : May 19, 2009
INVENTOR(S) : Norman R. Byrne It is certified that error appears in the above-identified patent and that said Letters Patent is hereby corrected as shown below:

Column 12, line 9 claim 1, the word “second” should be deleted.

Signed and Sealed this

Thirtieth Day of June, 2009

JOHN DOLL
*Acting Director of the United States Patent and Trademark Office*